US011117641B2

(12) United States Patent
Withers

(10) Patent No.: US 11,117,641 B2
(45) Date of Patent: Sep. 14, 2021

(54) SHADE SYSTEM

(71) Applicant: Taylor Made Group, LLC, Gloversville, NY (US)

(72) Inventor: Charles Robert Withers, Parrish, FL (US)

(73) Assignee: Taylor Made Group, LLC, Gloversville, NY (US)

( * ) Notice: Subject to any disclaimer, the term of this patent is extended or adjusted under 35 U.S.C. 154(b) by 208 days.

(21) Appl. No.: 15/598,466

(22) Filed: May 18, 2017

(65) Prior Publication Data

US 2017/0334524 A1 Nov. 23, 2017

Related U.S. Application Data

(60) Provisional application No. 62/338,158, filed on May 18, 2016.

(51) Int. Cl.
*B63B 17/02* (2006.01)

(52) U.S. Cl.
CPC ..... *B63B 17/02* (2013.01)

(58) Field of Classification Search
CPC ..... B63B 17/02
USPC ..... 114/361
See application file for complete search history.

(56) References Cited

U.S. PATENT DOCUMENTS

| | | | | |
|---|---|---|---|---|
| 3,955,228 | A | 5/1976 | Gaschenko et al. | |
| 5,044,686 | A | 9/1991 | Acenbrack | |
| 5,096,022 | A * | 3/1992 | Bowers | G09F 17/00 116/173 |
| 5,102,190 | A | 4/1992 | Akin et al. | |
| 5,441,066 | A * | 8/1995 | Harris | B63B 17/02 135/88.01 |
| 5,509,371 | A * | 4/1996 | Phillips | G09F 17/00 116/173 |
| 6,968,800 | B1 | 11/2005 | Becht | |
| 7,395,774 | B2 | 7/2008 | Borges et al. | |
| 7,685,960 | B1 | 3/2010 | Carusello et al. | |
| 8,770,213 | B2 | 7/2014 | Downey et al. | |
| 9,139,258 | B2 | 9/2015 | Russikoff | |
| 9,280,922 | B1 * | 3/2016 | Chery | G09F 17/00 |
| 9,326,573 | B1 | 5/2016 | Harris | |
| 9,725,136 | B1 * | 8/2017 | Silva | B63B 17/02 |
| 2014/0026803 | A1 * | 1/2014 | Musacchio | B63B 17/02 114/361 |
| 2016/0311503 | A1 * | 10/2016 | Duplain | B63B 17/04 |

* cited by examiner

*Primary Examiner* — Anthony D Wiest
(74) *Attorney, Agent, or Firm* — Nixon & Vanderhye P.C.

(57) ABSTRACT

A shade system for a structure includes a pair of support posts attachable to the structure, a shade panel including a plurality of attachment points around a periphery thereof, and at least one flexible lateral support member secured to the shade panel. The plurality of attachment points includes a fixture pair securable to a fixture of the structure, a post pair securable to the pair of support posts, respectively, and a side pair cooperable with the at least one flexible lateral support member and securable to the structure.

21 Claims, 4 Drawing Sheets

SHADE SYSTEM

CROSS-REFERENCES TO RELATED APPLICATIONS

This application claims the benefit of U.S. Provisional Patent Application No. 62/338,158, filed May 18, 2016, the entire content of which is herein incorporated by reference.

STATEMENT REGARDING FEDERALLY SPONSORED RESEARCH OR DEVELOPMENT (NOT APPLICABLE)

BACKGROUND

The invention relates to a shade system and, more particularly, to a temporary sun shade system attachable to a boat or other structure.

A temporary sun shade system may be attached to a boat that provides additional shade while the boat is moored. It usually attaches, on one side, to existing structure on the boat (t-top, arch, hard top, etc.) and is supported on an opposing side by poles (tension poles) that are inserted into rod holders or other mounts on the boat. Taylor Made Products offers a similar product and can be viewed at the following link http://www.taylormadeproducts.com/cgi-bin/catalog.pl?item_id=497

Typically, the shade width, or overall area coverage, is limited by the support pole locations, angle of mounts, and number of poles used. The sides of the shade are usually scalloped inward towards the center of the shade. The conventional way to increase that coverage is to add intermediate poles along the length that are angled outboard. Without the use of these additional poles, the longitudinal sides of the shade are required to be scalloped inward to provide tension along the length. It is desirable to optimize, or increase, the shade coverage without the addition of support poles.

Another limitation of the existing shade system is that the shape of the shade is primarily two dimensional. Shape can be influenced by the attachment structure on one side, but the remaining portion of the shade is relatively flat.

In addition, without the use of mid support poles, the longitudinal sides of the shade are unsupported and are less stable and tend to require additional tension to prevent the shade from fluttering with the wind. Mid support poles, attached to the deck, are undesirable as they limit or hinder usable space on the boat. In addition, they increase storage weight and space. They also significantly add to the cost of the shade system.

BRIEF SUMMARY

The shade system according to described embodiments herein may incorporate one or more removable mid-section lateral supports that span a width of the shade panel. The supports provide mid-section tension to the shade panel without the use of costly down supports. Additionally, lateral tension provided by the supports allows for wider area coverage. Still further, the added lateral supports allow for three-dimensional shape to be introduced to the shade structure.

The shade system may also include a variable attachment position support pole, which allows for the attachment position on the tension support pole to be variable in its location along the pole. At certain times while boating when the sun is low in the sky, early morning or late afternoon, the shade attached to the top ends of the support poles may not provide adequate shade. By enabling the attachment points of the shade to be repositioned, the necessary coverage can be achieved.

In an exemplary embodiment, a shade system for a structure includes a pair of support posts attachable to the structure, a shade panel including a plurality of attachment points around a periphery thereof, and at least one flexible lateral support member secured to the shade panel. The plurality of attachment points includes a fixture pair securable to a fixture of the structure, a post pair securable to the pair of support posts, respectively, and a side pair cooperable with the at least one flexible lateral support member and securable to the structure.

The shade panel may include a sleeve or loops on an underside thereof, and the at least one flexible lateral support member may be positioned through the sleeve or loops. The at least one flexible lateral support member may span a width of the shade panel. The at least one flexible lateral support member may be bendable in the sleeve or loops. The side pair of the plurality of attachment points may be configured to be positioned closer to each other than a length of the at least one flexible lateral support member to thereby deflect or bend the at least one flexible lateral support member upward in the sleeve or loops.

The side pair of the plurality of attachment points may include side straps attached at proximal ends to the shade panel and attachable at distal ends to the structure. The post pair of the plurality of attachment points may include straps attached to the pair of support posts, respectively.

Each of the pair of support posts may include a variable attachment position assembly for the post pair of the plurality of attachment points, where the variable attachment position assembly is configured to adjust an attachment position of the shade panel along the support posts. The variable attachment position assembly may include a pulley set, a cable displaceable over the pulley set, and a cleat attachment ring secured to the cable. The pulley set may include a pair of pulleys positioned adjacent top and bottom ends of the support posts, respectively. The post pair of the plurality of attachment points may be attached to the cleat attachment rings of the variable attachment position assemblies.

In another exemplary embodiment, the shade system is provided for a boat having a forward structure. The pair of support posts may be securable in rod holders on the boat.

In yet another exemplary embodiment, a shade system includes a pair of support posts attachable to the structure, a shade panel including a plurality of attachment points around a periphery thereof, and at least one flexible lateral support member secured to the shade panel. The plurality of attachment points includes a fixture pair securable to a fixture of the structure, a post pair securable to the pair of support posts, respectively, and a side pair cooperable with the at least one flexible lateral support member and securable to the structure. A position at which the post pair of the plurality of attachment points is securable to the pair of support posts is variable along a length of the support posts.

BRIEF DESCRIPTION OF THE DRAWINGS

These and other aspects and advantages will be described in detail with reference to the accompanying drawings, in which.

DETAILED DESCRIPTION

Figure 1:
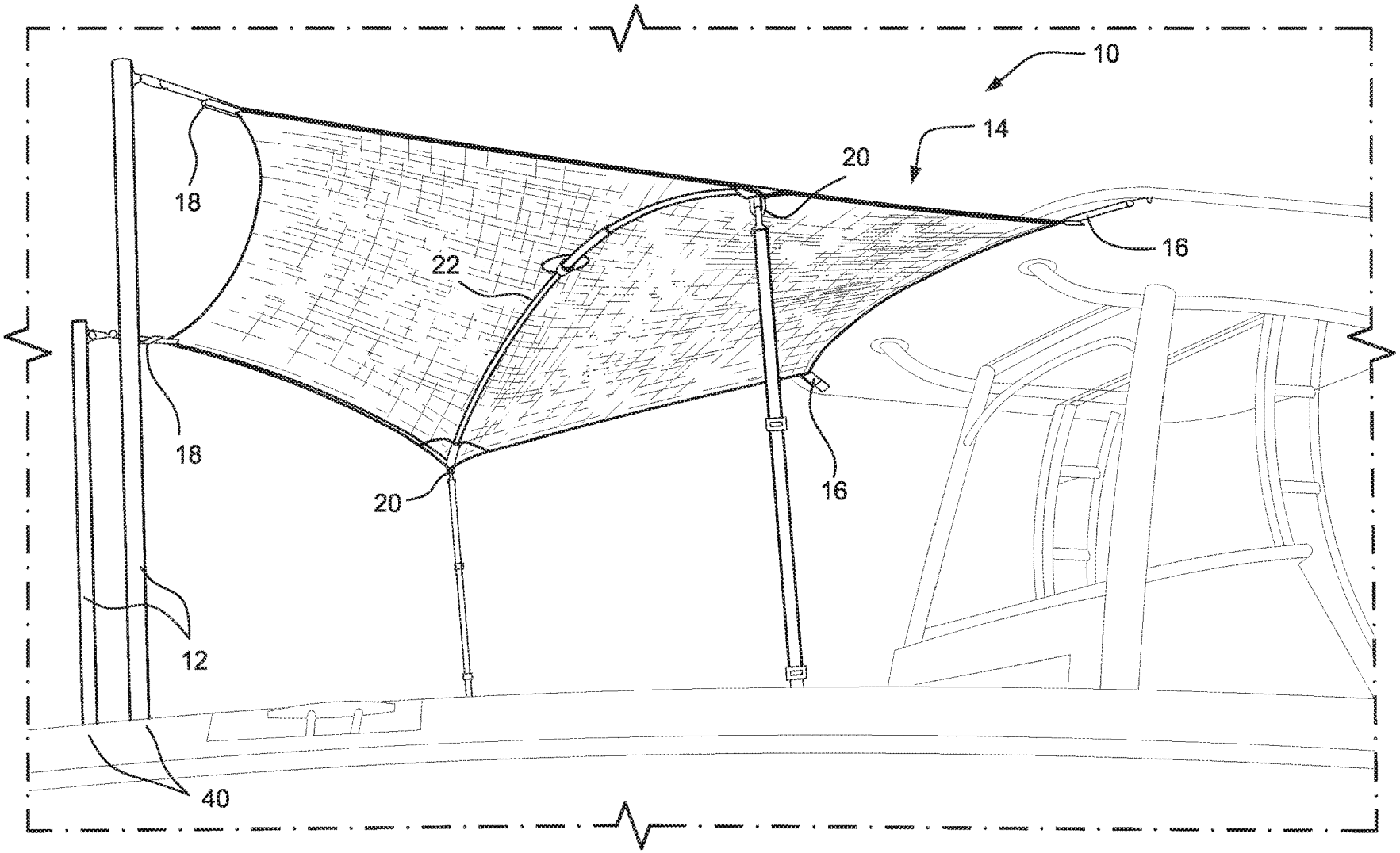
FIGS. 1 and 2 are perspective views of the shade system according to the described embodiments.
Figure 2:
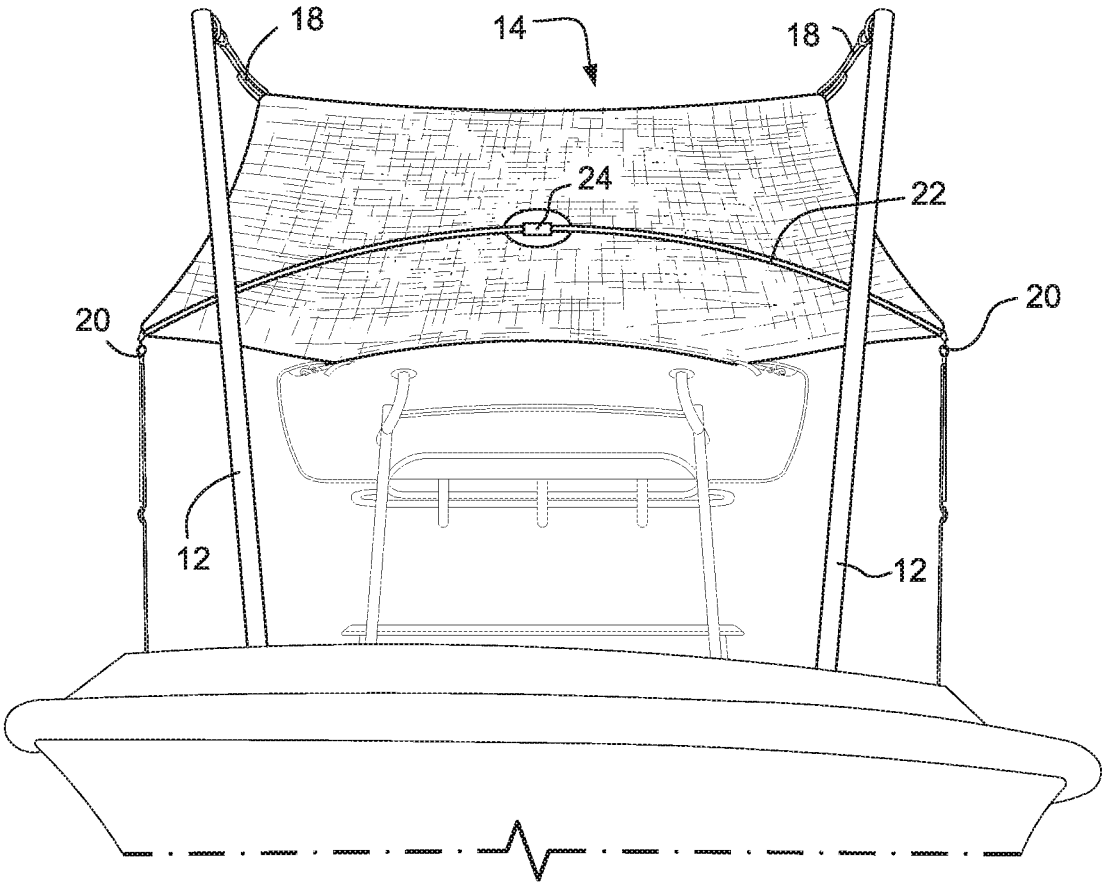

FIGS. 1 and 2 are perspective views of the shade system according to preferred embodiments. In the drawings, the shade system is secured to a top of a center console boat. The embodiment shown in the drawings, however, is exemplary, and the invention is not meant to be limited to the illustrated exemplary application. The shade system of the described embodiments is suitable for various applications.

The shade system 10 includes a pair of support posts 12 secured to the structure to which the shade system is applied (a boat hull in the illustrated exemplary embodiment). In the exemplary marine application shown in FIGS. 1 and 2, the support posts 12 may be securable in rod holders 40 on the boat or the like. A shade panel 14 includes a plurality of attachment points around a periphery thereof. The attachment points include a fixture pair 16 securable to a fixture (e.g., t-top, arch, hard top, etc.) of the structure, a post pair 18 securable to the pair of support posts 12, respectively, and a side pair 20. The shade system also includes at least one flexible lateral support member 22 secured to the shade panel 14. The side pair 20 of the plurality of attachment points are cooperable with the at least one flexible lateral support member 22 and are securable to the structure. The post pair 18 of the plurality of attachment points may comprise post straps attached to the pair of support posts 12 as shown. The side pair 20 of the plurality of attachment points may comprise side straps attached at proximal ends to the shade panel 14 and attachable at distal ends to the structure. The fixture pair 16 of the plurality of attachment points may similarly include straps or the like securable to the fixture of the structure.

Figure 3:
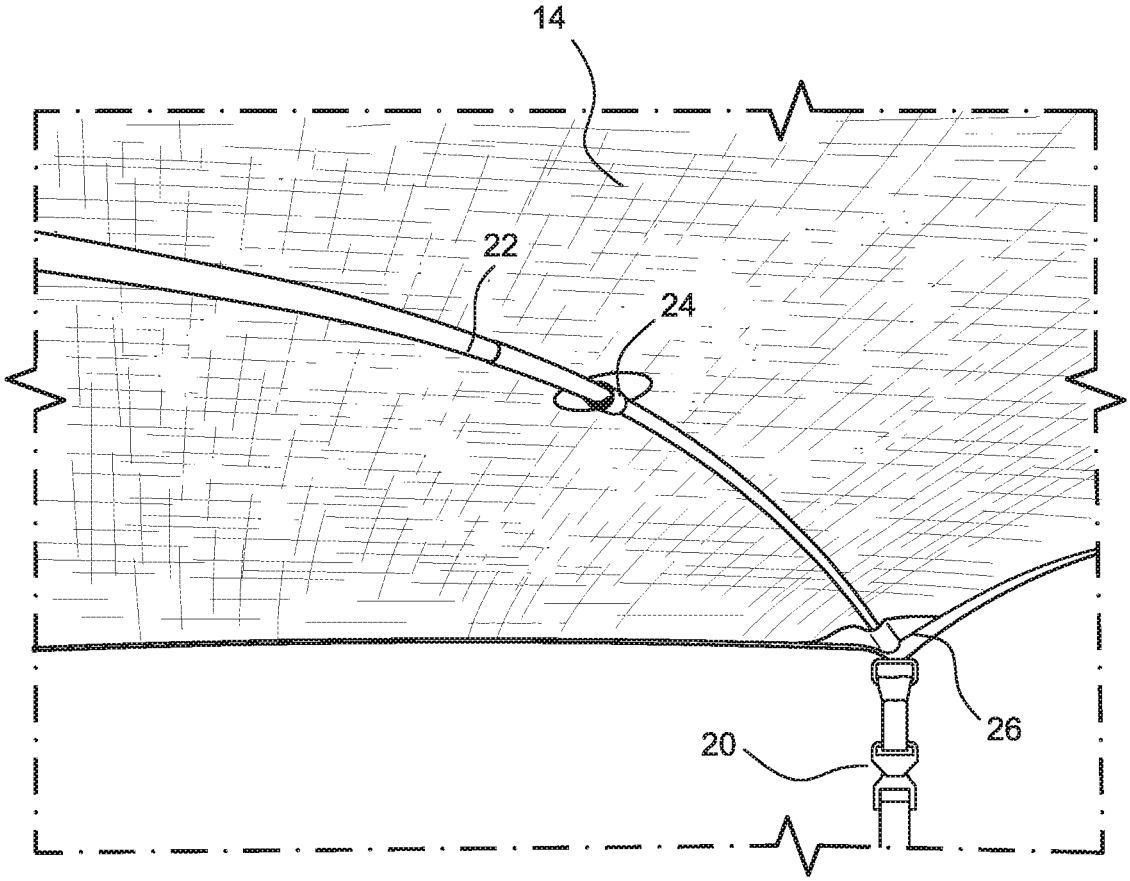
FIG. 3 is a close-up view of an underside of the shade panel.

FIG. 3 is a close-up view of an underside of the shade panel 14. The shade panel 14 includes one or more sleeves or loops 24 on an underside thereof, where the at least one flexible lateral support member 22 is positioned through the sleeve(s) or loops 24. The lateral support member 22 is bendable in the sleeve(s) or loops 24. Ends of the support member 22 are secured in suitable pockets 26 affixed to the underside of the shade panel 14 adjacent the side pair of attachment points 20. As shown in FIG. 1, the least one flexible lateral support member 22 may span a width of the shade panel 14. Due to the flexibility of the lateral support member 22, the side pair 20 of the plurality of attachment points may be configured to be positioned closer to each other than a length of the lateral support member 22. As a consequence, the lateral support member 22 may be deflected or bent upward across a width of the shade panel 14 to thereby provide a curved top shape for the shade panel 14.

Figure 4:
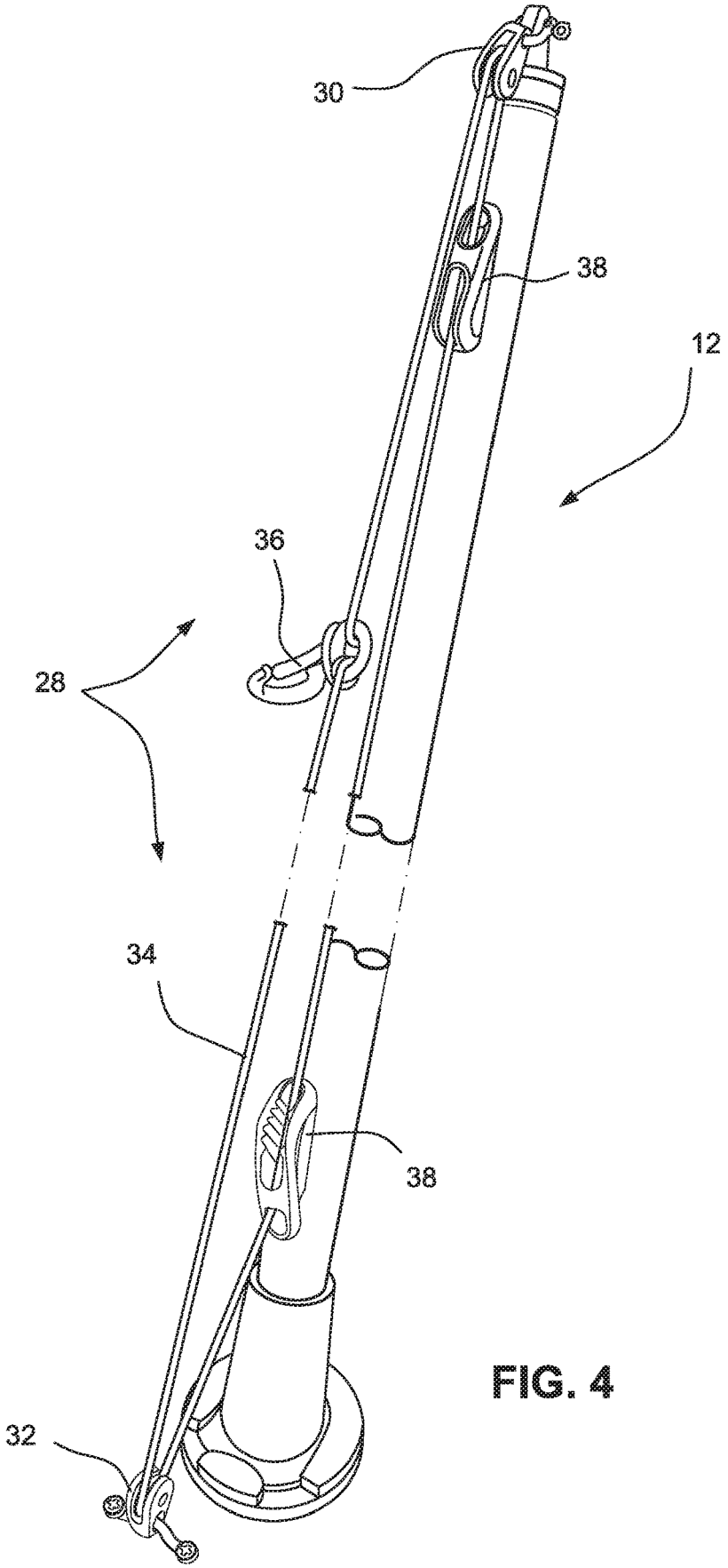
FIG. 4 shows an exemplary variable attachment position support pole.

As noted, it may be desirable to vary the attachment position of the post pair 18 of the plurality of attachment points on the support posts to vary an angle and/or coverage area of the shade panel, e.g., when the sun is low in the sky. FIG. 4 shows an exemplary support post 12 including a variable attachment position assembly 28 that is configured to adjust an attachment position of the shade panel 14 along the support posts 12. The variable attachment position assembly 28 includes an upper pulley 30 and a lower pulley 32. The lower pulley may be secured at a bottom end of the support post 12 or alternatively may be secured as shown in FIG. 4 on a surface of the structure adjacent the bottom end of the support post 12. The variable attachment position assembly 28 may also include a cable or rope 34 displaceable over the pulley set 30, 32 and a cleat attachment ring 36 secured to the cable 34. The assembly 28 may additionally include pulley guides 38 fixed to the support post 12 through which the rope or cable 34 is threaded. In use, the post pair 18 of the plurality of attachment points are attached to respective ones of the cleat attachment rings 36, and the position of the cleat attachment rings 36 is selectively adjustable between the pulleys 30, 32 by displacing the rope or cable 34. The cleat attachment rings 36 can be positioned anywhere between the pulleys 30, 32 allowing for infinite adjustment of the shade panel 14 position.

The pulleys can be traditional pulleys, eye straps, etc. provided that a looped rope or cable can span between them. The cleat may be any type of cleat (V-cleat, cam cleat, swiveling cleat, fairlead cleat, rope clutch, horn cleat, jam cleat, open base cleat, etc.) provided that it can secure the rope or cable at the desired position. The ring may be any type of ring (D-shaped, round, triangular, clip, etc.) provided that it will attach to the shade panel 14 attachment points 16, 18, 20.

The at least one flexible lateral support member 22 provides mid-section tension to the shade panel 14 without the use of costly down supports. Additionally, lateral tension provided by the flexible lateral support member 22 allows for wider area coverage. By attachment of the straps, cables, ropes etc. to the ends of the lateral supports 22, the three-dimensional shape is achievable. The straps, cables, ropes etc. can be secured at the opposite ends to the structure (e.g., deck or other parts of the boat), thereby causing the support to bend and induce shape into the shade panel. This attachment assembly provides additional stability to the shade panel. The attachment straps, cables, ropes etc. could also be attached to the opposing ends of the support to induce shape.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

The invention claimed is:

1. A shade system for a structure, the shade system comprising:

a pair of support posts attachable to the structure;

a shade panel including a plurality of attachment points around a periphery thereof; and at least one flexible lateral support member secured to the shade panel, wherein the plurality of attachment points includes a fixture pair securable to a fixture of the structure, a post pair securable to the pair of support posts, respectively, and a side pair cooperable with the at least one flexible lateral support member and securable to the structure, wherein the post pair are secured at distal ends thereof directly to the pair of support posts, respectively.

2. A shade system according to claim 1, wherein the shade panel comprises a sleeve or loops on an underside thereof, and wherein the at least one flexible lateral support member is positioned through the sleeve or loops.

3. A shade system according to claim 2, wherein the at least one flexible lateral support member spans a width of the shade panel.

4. A shade system according to claim 2, wherein the at least one flexible lateral support member is bendable in the sleeve or loops.

5. A shade system according to claim 4, wherein the side pair of the plurality of attachment points are configured to be positioned closer to each other than a length of the at least one flexible lateral support member to thereby deflect or bend the at least one flexible lateral support member upward in the sleeve or loops.

6. A shade system according to claim 1, wherein the side pair of the plurality of attachment points comprise side straps attached at proximal ends to the shade panel and attachable at distal ends to the structure.

7. A shade system according to claim 1, wherein the post pair of the plurality of attachment points comprise post straps attached directly to the pair of support posts, respectively.

8. A shade system according to claim 1, wherein each of the pair of support posts comprises a variable attachment position assembly to which the post pair of the plurality of attachment points are secured, the variable attachment position assembly being configured to adjust an attachment position of the shade panel along the support posts.

9. A shade system according to claim 8, wherein the variable attachment position assembly comprises a pulley set, a cable displaceable over the pulley set, and a cleat attachment ring secured to the cable.

10. A shade system according to claim 9, wherein the pulley set comprises a pair of pulleys positioned adjacent top and bottom ends of the support posts, respectively.

11. A shade system according to claim 9, wherein the post pair of the plurality of attachment points are attached to the cleat attachment rings of the variable attachment position assemblies.

12. A shade system according to claim 1, wherein the fixture pair of the plurality of attachment points comprise first straps securable directly to the fixture of the structure, wherein the side pair of the plurality of attachment points comprise second straps securable directly to the structure, and wherein the first and second straps are the only direct connections between the shade panel and the structure.

13. A shade system for a boat having a forward structure and a coverage area, the shade system comprising:

a pair of support posts attachable to the boat and extendable to a height above the coverage area;

a shade panel including a plurality of attachment points around a periphery thereof; and at least one flexible lateral support member secured to the shade panel, wherein the plurality of attachment points includes a fixture pair securable to the forward structure of the boat, a post pair securable to the pair of support posts, respectively, and a side pair cooperable with the at least one flexible lateral support member and securable to the boat, the side pair including a pair of straps respectively attachable to the boat, wherein the post pair comprises post straps attached at distal ends thereof directly to the pair of support posts above the coverage area and secured between the shade panel and the pair of support posts, respectively.

14. A shade system according to claim 13, wherein the pair of support posts are securable in rod holders on the boat.

15. A shade system according to claim 13, wherein each of the pair of support posts comprises a variable attachment position assembly for the post pair of the plurality of attachment points, the variable attachment position assembly being configured to adjust an attachment position of the shade panel along the support posts.

16. A shade system according to claim 15, wherein the variable attachment position assembly comprises a pulley set, a cable displaceable over the pulley set, and a cleat attachment ring secured to the cable.

17. A shade system according to claim 15, wherein the post pair of the plurality of attachment points are attached to the cleat attachment rings of the variable attachment position assemblies.

18. A shade system for a structure, the shade system comprising:

a pair of support posts attachable to the structure;

a shade panel including a plurality of attachment points around a periphery thereof; and at least one flexible lateral support member secured to the shade panel, wherein the plurality of attachment points includes a fixture pair securable to a fixture of the structure, a post pair securable to the pair of support posts, respectively, and a side pair cooperable with the at least one flexible lateral support member and securable to the structure, wherein the post pair are directly secured at distal ends thereof to the pair of support posts, respectively, and wherein a position at which the post pair of the plurality of attachment points is securable to the pair of support posts is variable along a length of the support posts.

19. A shade system according to claim 18, wherein the shade panel comprises a sleeve or loops on an underside thereof, and wherein the at least one flexible lateral support member is positioned through the sleeve or loops.

20. A shade system according to claim 19, wherein the at least one flexible lateral support member is bendable in the sleeve or loops.

21. A shade system according to claim 19, wherein the side pair of the plurality of attachment points are configured to be positioned closer to each other than a length of the at least one flexible lateral support member to thereby deflect or bend the at least one flexible lateral support member upward in the sleeve or loops.

* * * * *